US008765051B2

(12) United States Patent
Reichel

(10) Patent No.: US 8,765,051 B2
(45) **Date of Patent: *Jul. 1, 2014**

(54) METHOD AND DEVICE FOR PRODUCING PIG-IRON BASED STAINLESS STEEL WITHOUT USING A SUPPLY OF ELECTRICAL ENERGY

(75) Inventor: Johann Reichel, Düsseldorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/428,854

(22) Filed: Mar. 23, 2012

(65) Prior Publication Data

US 2012/0175828 A1 Jul. 12, 2012

Related U.S. Application Data

(62) Division of application No. 12/312,882, filed as application No. PCT/EP2007/010012 on Nov. 20, 2007.

(30) Foreign Application Priority Data

Nov. 30, 2006 (DE) ..... 10 2006 056 672

(51) Int. Cl.
*C21B 13/14* (2006.01)
*C21C 7/064* (2006.01)
*C21C 7/068* (2006.01)

(52) U.S. Cl.
USPC ..... 266/142; 266/208; 266/217

(58) Field of Classification Search
USPC ..... 266/142, 208, 217
See application file for complete search history.

(56) References Cited

U.S. PATENT DOCUMENTS 7,819,940 B2 10/2010 Reichel

FOREIGN PATENT DOCUMENTS

| | | |
|---|---|---|
| DE | 1508284 | 5/1970 |
| DE | 2014339 | 10/1970 |
| DE | 1940761 | 2/1971 |
| DE | 19621143 | 8/1997 |

(Continued)

OTHER PUBLICATIONS

Nishimura et al. JP 08092614A. Apr. 9, 1996. Machine translation.*

(Continued)

*Primary Examiner* — George Wyszomierski
*Assistant Examiner* — Tima M McGuthry Banks
(74) *Attorney, Agent, or Firm* — Lucas & Mercanti, LLP; Klaus P. Stoffel

(57) ABSTRACT

An installation for producing stainless steel for all stainless steel products both in the austenitic and the ferritic range, based on liquid pig-iron and FeCr solids, without using a supply of electrical energy. The liquid pig-iron, after being pre-treated in a blast furnace, is subjected to a DDD treatment (dephosphorisation, desiliconisation and desulphuration), is heated, finished or alloyed and deoxidated. The quantity of slag-free liquid pig-iron that has been pre-treated in the blast furnace is separated and introduced into two classic "twin" AOD-L converters, where the required chemical process steps (of the DDD treatment and of the heating, decarburization and alloying stages) take place in parallel contrary processes using autogenous chemical energy, the DDD treatment being carried out first in the first twin AOD-L converter and the decarburization being carried out first in the second twin AOD-L converter.

2 Claims, 1 Drawing Sheet

(56) References Cited

FOREIGN PATENT DOCUMENTS

| | | | | |
|---|---|---|---|---|
| EP | 1310573 | | 5/2003 | |
| GB | 1131944 | | 10/1968 | |
| GB | 1311290 | | 3/1973 | |
| GB | 2141739 | | 1/1985 | |
| JP | 59182909 | A * | 10/1984 | ..... C21C 5/48 |
| JP | 59211519 | | 11/1984 | |
| JP | 08092614 | A * | 4/1996 | |
| JP | 9302405 | | 11/1997 | |
| WO | 02075003 | | 9/2002 | |
| WO | 03106716 | | 12/2003 | |
| WO | WO 03103716 | A1 * | 12/2003 | |
| WO | 2006050963 | | 5/2006 | |

OTHER PUBLICATIONS

Meierling et al. WO 03103716. Dec. 24, 2003. Machine translation.*

* cited by examiner

Fig. 1
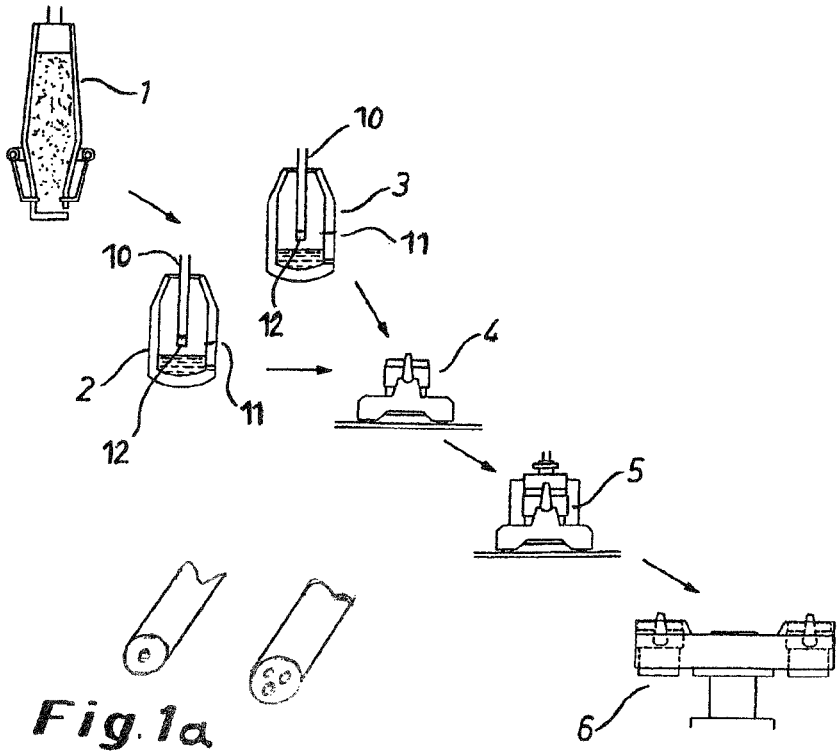
Fig. 1a
Fig. 2
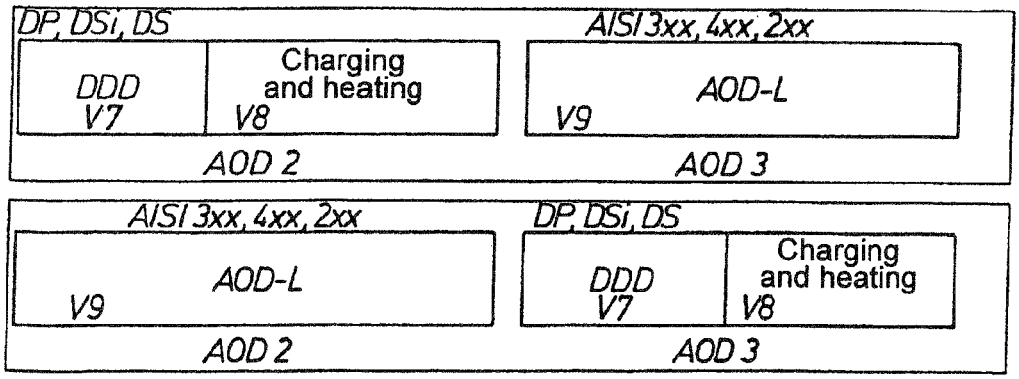

METHOD AND DEVICE FOR PRODUCING PIG-IRON BASED STAINLESS STEEL WITHOUT USING A SUPPLY OF ELECTRICAL ENERGY

CROSS-REFERENCE TO RELATED APPLICATIONS

The present application is a Divisional Application of U.S. patent application Ser. No. 12/312,882, filed Jul. 20, 2009, issued on Apr. 30, 2013 as U.S. Pat. No. 8,430,945, which is a 371 of International application PCT/EP2007/010012, filed Nov. 20, 2007, which claims priority of DE 10 2006 056 672.6, filed Nov. 30, 2006, the priority of these applications is hereby claimed and these applications are incorporated herein by reference.

BACKGROUND OF THE INVENTION

The present invention relates to a method and a device for stainless steel production without electrical energy supply on the basis of liquid pig-iron and FeCr solids, wherein, after a pretreatment in a blast furnace and a DDD treatment (dephosphorization, desiliconization, desulpherization) in a DDD installation, the liquid pig-iron is subsequently heated, refined or alloyed in an AOD converter, is reduced and finally an adaptation/adjustment of the treated steel melt is carried out in a ladle furnace.

The use of an AOD converter for manufacturing noble steels is already known. Thus WO 02/075003 describes a control method based on a continuous measurement of exhaust gases in combination with a computer and a dynamic model by means of which the necessary blow rates of oxygen and inert gas as well as the material charges are controlled.

EP 1 310 573 A2 discloses a method for manufacturing a metal melt, particularly for quenching a metal melt for manufacturing, for example, alloyed stainless steel or noble steel in an AOD converter, wherein the method is based on a computer technology which takes place in accordance with a process model and which controls the metallurgical installation, the process model describes the behavior for at least one variable process parameter between a first process value, an adjusting value, and a final process value. An example describes the process sequence for manufacturing a steel of the class AISI 304.

Stainless steels of the ferritic steel group AISI 4xx are conventionally always manufactured from scrap of the same type in the EAF and are later additionally alloyed and decarbonized in the AOD converter. In order to utilize the use of pig-iron, pig-iron pretreated in a steel mill with scrap and alloy melted into the pig-iron is mixed in a ladle outside of the furnace and is then charged into the converter.

WO 2006/050963 A2 proposes a method for producing stainless steel of the ferritic steel group AISI 4xx, particularly the steel group AISI 430, on the basis of liquid pig-iron and FeCr solids, with a DDD process line and the AOD converter with successively carried out method steps:

- Pretreatment of the liquid pig-iron in the blast installation and charging of the AOD converter with slag-free liquid pig-iron,
- Heating, refining/alloying, and reducing the liquid pig-iron in the AOD converter,
- Final adaptation/adjustment of the treated steel melt in the casting ladle.

In this known method, the manufacture of the stainless steel is carried out advantageously with the use of the AOD converter without the use of an EAF, i.e., without the supply of electrical energy. However, this known method has the disadvantage that finally because of the lack of energy in this method only the manufacture of ferritic steels is possible.

SUMMARY OF THE INVENTION

The object of the invention resides in utilizing the method known from WO 2006/050963 A2 with AOD technology for directly charging the pig-iron and subsequent alloying in the converter for the production of stainless steel of all stainless qualities, for example, AISI 3xx, 4xx, 2xx, in the austenitic as well as in the ferritic range with the use of autogenic chemical energy.

The above object for manufacturing stainless steel of the mentioned steel quality is solved in that, for the stainless steel production of all stainless qualities in the austenitic range as well as in the ferritic range, the slag-free liquid pig-iron quantity pretreated in the blast furnace is separated and introduced into two classic "Twin" AOD-L converters, in which the required chemical process steps (heating, decarbonizing, and alloying) are carried out with the use of autogenic chemical energy in a parallel contrary sequence with the use of autogenic chemical energy, wherein initially the DDD treatment is carried out in the first "Twin" AOD-L converter and decarbonization is initially carried out in the second "Twin" AOD-L converter.

Advantageous embodiments of the invention are mentioned in the dependent claims.

After concluding the DDD treatment, a deslagging of the pig-iron is necessary prior to the subsequent heating in the converter, because the typical AOD process is supposed to start slag-free. This also increases the efficiency of the lance which is used in the second AOD-converter and a free surface of the melt is ensured for soaking the process gases.

Heating of the pig-iron to a desired temperature or a temperature which is required for the subsequent process steps takes place by Si-oxidation. For this purpose, FeSi is charged into the "Twin" AOD-L converter and an oxygen/inert gas mixture is blown through the side nozzles of a top lance into and onto the pig-iron. For this purpose, a three-hole top lance or four-hole top lance is used in the first "Twin" AOD-L converter, and a single-hole top lance for the AOD-L process is used in the second AOD-L converter.

Since heating of the initial metal is carried out according to the invention after the DDD treatment, it is especially possible to charge Ni or Ni-alloys into the "Twin" AOD-L converters. In this manner, the balance energy can be carried out in any chosen manner.

Because of the contrary sequence of the process steps carried out at different times in the two "Twin" AOD-L converters, decarbonization and alloying of the melt takes place in the first "Twin" AOD-L converter after the conclusion of the DDD treatment and the charging and heating of decarbonization at alloying, while in the second "Twin" AOD-L converter, after conclusion of the classical decarbonization and/or treatment steps belonging thereto (such as, for example, desulphurization and alloying including tapping), the pig-iron is heated.

Because of the separation of the pretreated slag-free liquid pig-iron quantity according to the invention into two "Twin" AOD-L converters arranged in parallel in the process line after the blast furnace and the DDD installation, and the process steps are carried out in the converters in a contrary manner, the production of all RST steel qualities is facilitated in an advantageous manner. Simultaneously, a decoupling of the requirement of electrical energy for all qualities takes place because the only energy carrier used is the autogenic chemical energy already present in the pig-iron and introduced through the charged FeSi. Moreover, this separation of the pig-iron quantity and the process pattern, a reliable temperature pattern, reduced process costs as well as reduced investment costs are achieved because always only a small pig-iron quantity has to be treated at a given time.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

BRIEF DESCRIPTION OF THE DRAWING

In the drawing:

FIG. 1 is a process line showing an example,

FIG. 1*a* shows schematic representations of a single hole top lance and a three-hole top lance, FIG. 2 shows the contrary process pattern in two "Twin" AOD-L converters.

DETAILED DESCRIPTION OF THE INVENTION

In FIG. 1, a drawing figure illustrates an example of a process line for the manufacture of stainless steel. After emerging from the blast furnace 1 and a DDD treatment, the liquid pig-iron quantity is divided and introduced into two "Twin" AOD-L converters 2, 3 which are arranged in parallel. In the converters, in a contrary sequence of the process steps, the DDD treatment takes place and the refinement and alloying of the liquid pig-iron. After the treatment in the "Twin" AOD-L converters 2, 3, the steel melt from the two "Twin" AOD-L is brought together in a ladle 4 and is brought for the final adaptation/adjustment in the ladle furnace 5 and to the casting machine 6. The converters 2, 3 have side nozzles 11 and a top lance 10. Each top lance has a lance head 12. FIG. la shows a schematic representation of a three hole top lance and a single hole top lance which are conventional in the art.

FIG. 2 shows the contrary sequence of the process steps carried out in the "Twin" AOD-L converters 2 and 3. While starting with a DDD treatment V7 by means of FeSi, a DDD treatment V7 is carried out in the "Twin" AOD-L converter 2 (on the left hand side in the drawing), with subsequent AOD treatment V9 with decarbonization and alloying for producing, for example, AISI 3xx, 4xx, 2xx stainless steel qualities, simultaneously in the "Twin" AOD-L converter 3 (shown on the right hand in the drawing). Initially, the AOD treatment V9 is carried out and only then charging and heating V8 of the pig-iron.

The selected illustration in FIG. 2 has the purpose of particularly clearly emphasizing that the same method steps are not carried out at any time simultaneously in the converters 2, 3, on which are based the division of the method in two converters providing the process-technological advantage of the invention which is the separation of the method into two converters.

Consequently, the DDD treatment and charging and heating in the converter 2 is synchronized with the AOD-L treatment in the converter 3 and vice versa. The AOD-L treatment in the converter 2 is synchronized with the charging and heating steps in the converter 3.

While specific embodiments of the invention have been shown and described in detail to illustrate the inventive principles, it will be understood that the invention may be embodied otherwise without departing from such principles.

I claim:

1. Installation for stainless steel production without electrical energy supply based on liquid pig-iron and FeCr solids, in which the liquid pig-iron is heated, refined and alloyed after a pretreatment in a blast furnace, and is subjected to a dephosphorization, desiliconization, desulphurization (DDD) treatment, comprising two classical Argon Oxygen Decarburization with Lance (AOD-L) converters arranged in parallel in a process line following the blast furnace, which each receive a partial quantity of a total pig-iron quantity pretreated in the blast furnace; wherein each of the converters subjects the pig-iron to the DDD treatment, wherein the converters are equipped with side nozzles and a top lance, wherein a first of the AOD-L converters has a top lance whose lance head with three or four holes corresponds to Basic Oxygen Furnace (BOF) blowing technology and a second of the AOD-L converters has a single-hole top lance which is typical for the Argon Oxygen Decarburization (AOD) process, the AOD-L converters being operatively arranged so as to carry out, in a parallel contrary sequence, chemical process steps of heating, and decarbonizing and alloying using autogenic chemical energy, wherein initially the DDD treatment and charging and heating are carried out in the first AOD-L converter and decarbonization is initially carried out in the second AOD-L converter.

2. Installation for stainless steel production without electrical energy supply based on liquid pig-iron and FeCr solids, in which the liquid pig-iron is heated, refined and alloyed after a pretreatment in a blast furnace, and is subjected to a dephosphorization, desiliconization, desulphurization (DDD) treatment, comprising two classical Argon Oxygen Decarburization with Lance (AOD-L) converters arranged in parallel in a process line following the blast furnace, which each receive a partial quantity of a total pig-iron quantity pretreated in the blast furnace; wherein each of the converters subjects the pig-iron to the DDD treatment, wherein the converters are equipped with side nozzles and a top lance, wherein a first of the AOD-L converters has a top lance whose lance head with three or four holes corresponds to Basic Oxygen Furnace (BOF) blowing technology, wherein the second AOD-L converter is equipped with a three-hole top lance, the AOD-L converters being operatively arranged so as to carry out, in a parallel contrary sequence, chemical process steps of heating, and decarbonizing and alloying using autogenic chemical energy, wherein initially the DDD treatment and charging and heating are carried out in the first AOD-L converter and decarbonization is initially carried out in the second AOD-L converter.

* * * * *